US008578924B2

(12) United States Patent
Elkasevic et al.

(10) Patent No.: US 8,578,924 B2
(45) Date of Patent: Nov. 12, 2013

(54) EXHAUST BAFFLE FOR KITCHEN APPLIANCE

(75) Inventors: Suad Elkasevic, Winterville, NC (US); Michael Penuel, Swansboro, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 334 days.

(21) Appl. No.: 13/191,538

(22) Filed: Jul. 27, 2011

(65) Prior Publication Data

US 2013/0025581 A1 Jan. 31, 2013

(51) Int. Cl.
*F24C 15/32* (2006.01)

(52) U.S. Cl.
USPC ..... 126/21 R; 126/19 R; 126/21 A; 126/190; 126/193; 126/299 R; 248/176.2; 248/300; 219/757

(58) Field of Classification Search
USPC .. 126/21 R, 21 A, 299 R, 299 D, 1 AA, 19 R, 126/198, 190, 193, 41 R; 219/757, 682, 756, 219/681, 751, 762, 763, 400; 137/47, 53, 137/343; 248/174, 179.1, 200, 205.1, 201, 248/300, 346.01, 346.06, 176.2, 906; 165/47, 104.19, 104.14, 901, 122, 70
See application file for complete search history.

(56) References Cited

U.S. PATENT DOCUMENTS 1,169,694 A * 1/1916 Swisher ..... 126/21 R
3,322,111 A * 5/1967 Simpson et al. ..... 126/21 R
3,783,854 A * 1/1974 Hurko et al. ..... 126/21 R
4,241,718 A * 12/1980 Barnett ..... 126/21 R
4,601,279 A * 7/1986 Guerin ..... 126/21 A
4,867,132 A * 9/1989 Yencha ..... 126/21 A
4,928,663 A * 5/1990 Nevin et al. ..... 126/21 A
5,387,258 A * 2/1995 Puricelli ..... 126/21 A
5,701,882 A * 12/1997 Champion ..... 126/523
5,807,425 A * 9/1998 Gibbs ..... 96/66
5,906,197 A * 5/1999 French et al. ..... 126/512
5,960,786 A * 10/1999 Lambertson ..... 126/299 D
7,111,623 B2 * 9/2006 Brennan ..... 126/512
7,116,900 B2 * 10/2006 Johnson ..... 392/407
7,296,565 B2 * 11/2007 Kim et al. ..... 126/198
7,692,124 B2 * 4/2010 Lee ..... 219/757
7,762,250 B2 * 7/2010 Elkasevic et al. ..... 126/198
7,992,552 B2 * 8/2011 Hirano et al. ..... 126/21 A
8,042,533 B2 * 10/2011 Dobie et al. ..... 126/21 A
8,166,965 B2 * 5/2012 Miles et al. ..... 126/523
8,246,705 B2 * 8/2012 Bain et al. ..... 55/467
8,281,778 B2 * 10/2012 Chang ..... 126/15 R
8,378,265 B2 * 2/2013 Greenwood et al. ..... 219/391

(Continued)

*Primary Examiner* — Kenneth Rinehart
*Assistant Examiner* — Bao D Nguyen
(74) *Attorney, Agent, or Firm* — James E. Howard; Andre Pallapies

(57) ABSTRACT

An exhaust baffle is provided for a domestic appliance. The exhaust baffle includes a support bracket having two tabs, the tabs being configured to slide into engagement with slots formed in the base of the domestic appliance, two support elements, each of the support elements extending from one of the tabs at an angle and having a bearing surface, and a bridging element that extends from the two support elements at an angle, the bridging element connecting the two support elements; a baffle top having a hot gas directing portion that rests on the bearing surfaces of the support bracket and an opening that receives the bridging element; and a baffle bottom having a substantially flat member, the baffle bottom holding the support bracket in the slots when the baffle bottom is in an operating position.

20 Claims, 4 Drawing Sheets

(56) References Cited

U.S. PATENT DOCUMENTS

| | | | | |
|---|---|---|---|---|
| 8,464,701 | B2 * | 6/2013 | Karabin et al. | 126/21 R |
| 2001/0032641 | A1 * | 10/2001 | Campbell et al. | 126/512 |
| 2003/0111071 | A1 * | 6/2003 | Perrault | 126/77 |
| 2005/0224068 | A1 * | 10/2005 | Kim et al. | 126/198 |
| 2006/0283442 | A1 * | 12/2006 | Miles et al. | 126/523 |
| 2008/0149089 | A1 * | 6/2008 | Karabin et al. | 126/21 R |
| 2013/0174832 | A1 * | 7/2013 | ARMSTRONG et al. | 126/21 R |

* cited by examiner

FIG. 2
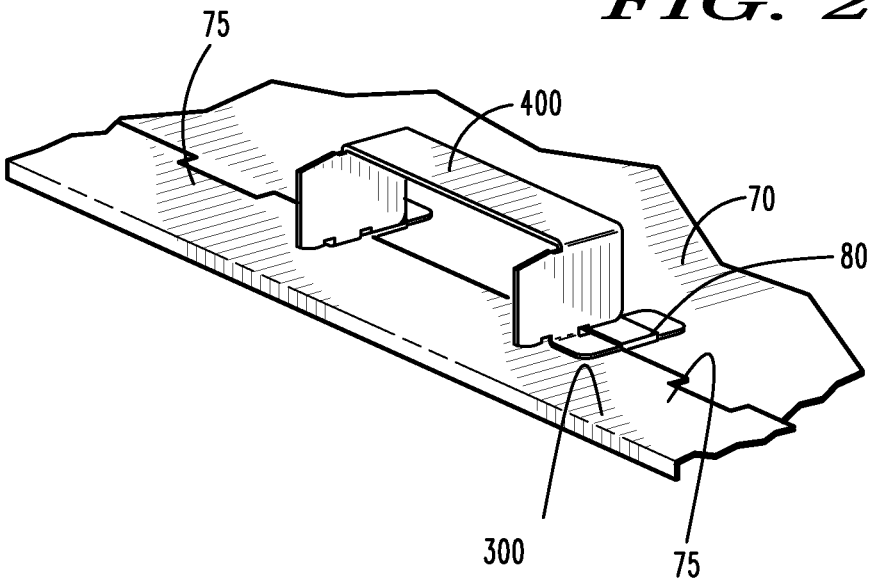
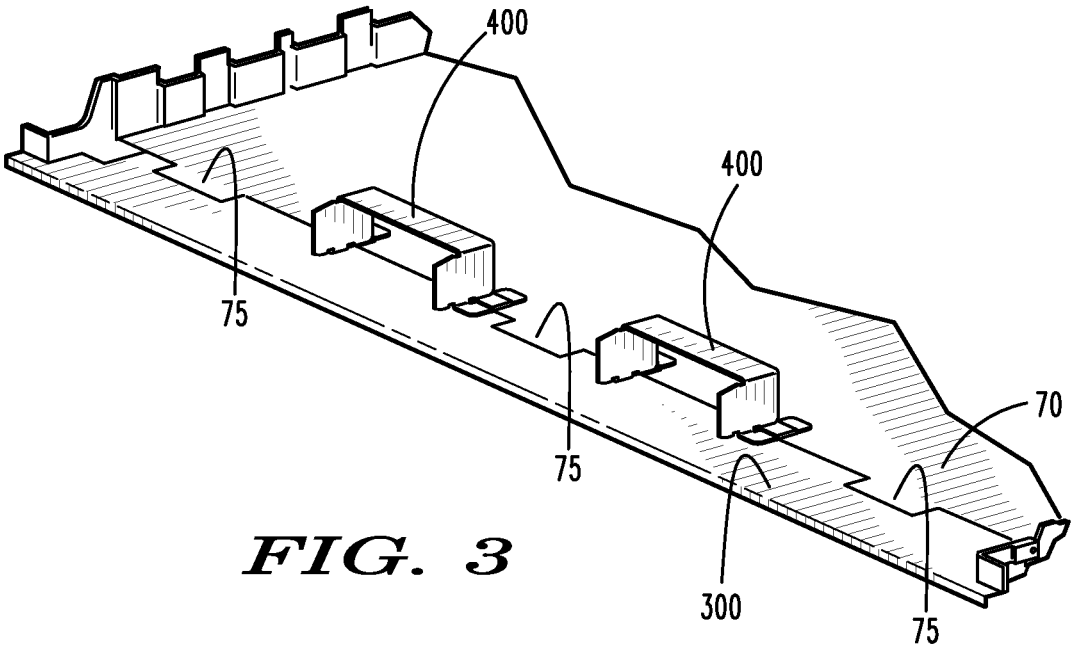
FIG. 3

EXHAUST BAFFLE FOR KITCHEN APPLIANCE

FIELD OF THE INVENTION

The invention is directed to an exhaust baffle for a kitchen appliance.

An example of an application for the invention is an exhaust baffle in a domestic kitchen oven that exhausts hot gases.

BACKGROUND OF THE INVENTION

Many domestic appliances, such as built in ovens, have a need to exhaust hot gases from either the oven itself, or from around the outside of the oven. This is particularly true of ovens that are built in to a cabinet.

Such ovens can have an exhaust port, or area, that includes a baffle to direct the exhaust gases in a direction that assists in cooling the oven and is least offensive to the user. These baffles can be positioned at the bottom of the oven and, as a result, may need to support a portion of the weight of the oven.

Some exhaust baffle designs provide strength through a multitude of welds or other expensive connections. Some designs also transfer the weight of the oven through a top plate of the baffle, which can require a costly and elaborate structure to avoid unsightly distortion of the top plate.

SUMMARY

The invention recognizes that it is desirable to provide a strong exhaust baffle that is simple and inexpensive to produce and assemble but also provides an attractive appearance.

Particular embodiments of the invention are directed to an exhaust baffle for exhausting hot gas from around a domestic appliance having a base. The exhaust baffle includes a support bracket having two tabs, the tabs being configured to slide into engagement with slots formed in the base of the domestic appliance, two support elements, each of the support elements extending from one of the tabs at a first angle that is greater than zero degrees and having a bearing surface, and a bridging element that extends from the two support elements at a second angle that is greater than zero degrees, the bridging element connecting the two support elements; a baffle top having two opposite ends, a hot gas directing portion that rests on the bearing surfaces of the support bracket, an opening that receives the bridging element, and an attachment bracket at each of the two ends, the attachment brackets each having at least one attachment member that attaches the baffle top to at least one of the baffle bottom and the base of the domestic appliance; and a baffle bottom having a substantially flat member, the baffle bottom holding the support bracket in the slots when the baffle bottom is in an operating position.

Other embodiments of the invention are directed to an exhaust baffle/appliance base combination for exhausting hot gas from around a domestic appliance. The combination includes a base of the domestic appliance, the base having slots formed therein; a support bracket having two tabs, the tabs sliding into engagement with the slots formed in the base of the domestic appliance, two support elements, each of the support elements extending from one of the tabs at a first angle that is greater than zero degrees and having a bearing surface, and a bridging element that extends from the two support elements at a second angle that is greater than zero degrees, the bridging element connecting the two support elements; a baffle top having two opposite ends, a hot gas directing portion that rests on the bearing surfaces of the support bracket, an opening that receives the bridging element, and an attachment bracket at each of the two ends, the attachment brackets each having at least one attachment member that attaches the baffle top to at least one of the baffle bottom and the base of the domestic appliance; and a baffle bottom having a substantially flat member, the baffle bottom holding the support bracket in the slots when the baffle bottom is in an operating position.

Other embodiments of the invention are directed to a domestic appliance that exhausts hot gas. The domestic appliance includes an appliance body including a heat source; a base having slots formed therein; a support bracket having two tabs, the tabs sliding into engagement with the slots formed in the base, two support elements, each of the support elements extending from one of the tabs at a first angle that is greater than zero degrees and having a bearing surface, and a bridging element that extends from the two support elements at a second angle that is greater than zero degrees, the bridging element connecting the two support elements; a baffle top having two opposite ends, a hot gas directing portion that rests on the bearing surfaces of the support bracket, an opening that receives the bridging element, and an attachment bracket at each of the two ends, the attachment brackets each having at least one attachment member that attaches the baffle top to at least one of the baffle bottom and the base of the domestic appliance; and a baffle bottom having a substantially flat member, the baffle bottom holding the support bracket in the slots when the baffle bottom is in an operating position.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein:

FIG. 2 is a partial perspective view of a portion of a baffle in accordance with an exemplary embodiment of the invention;

FIG. 3 is a partial perspective view of a portion of a baffle in accordance with an exemplary embodiment of the invention;

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

Figure 1:
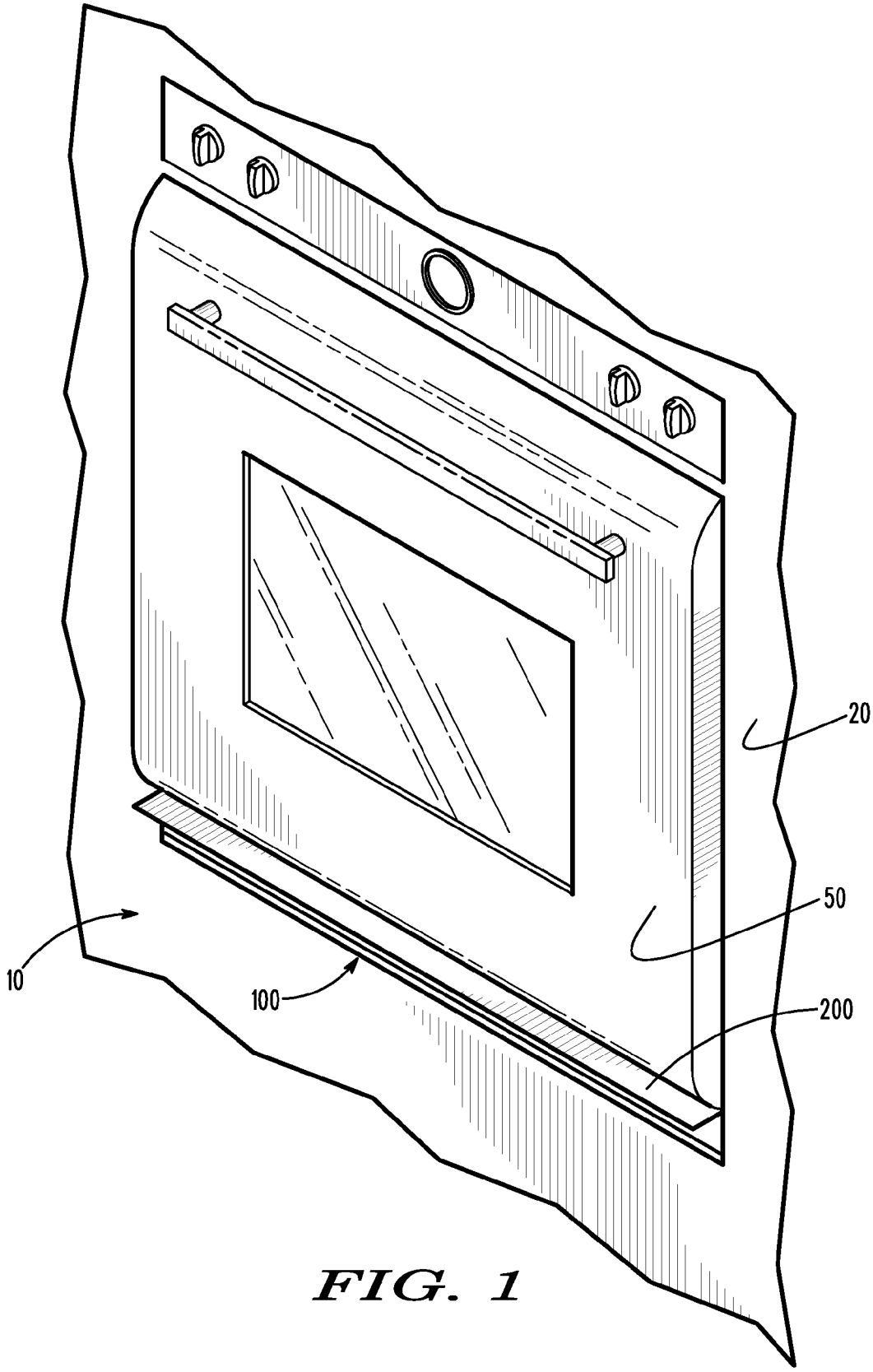
FIG. 1 is a perspective view of a domestic appliance in accordance with an exemplary embodiment of the invention.

FIG. 1 shows an example of a domestic appliance, in this case an oven 50, mounted in a cabinet 10 having a cabinet face 20. In this example, an exhaust baffle 100 is located below oven 50 for exhausting hot gases from around the oven.

An example of an exhaust baffle in accordance with an embodiment of the invention, and in particular the assembly of the exhaust baffle, is shown in FIGS. 2-5.

FIGS. 2 and 3 show an oven base plate 70 that can be an integral part of oven 50 or a plate on which oven 50 sits. In this example, base plate 70 is substantially flat with various strengthening features such as, for example, bulges and creases. Hot gases are directed over base plate 70 and below a body of oven 50 by a fan or other gas moving device and then out of exhaust baffle 100. Base plate 70 is shown having a plurality of protrusions 75 that mate with a bottom plate 300 (described in more detail below). Base plate 70 also has a plurality of slots 80 for receiving tabs of one or more support brackets 400 (an example of a support bracket 400 is shown in more detail in FIG. 6). In this example, slots 80 are cut portions of base plate 70 that are elevated to receive tab 460 of support bracket 400. FIG. 3 shows two support brackets 400 in position on base plate 70.

Figure 6:
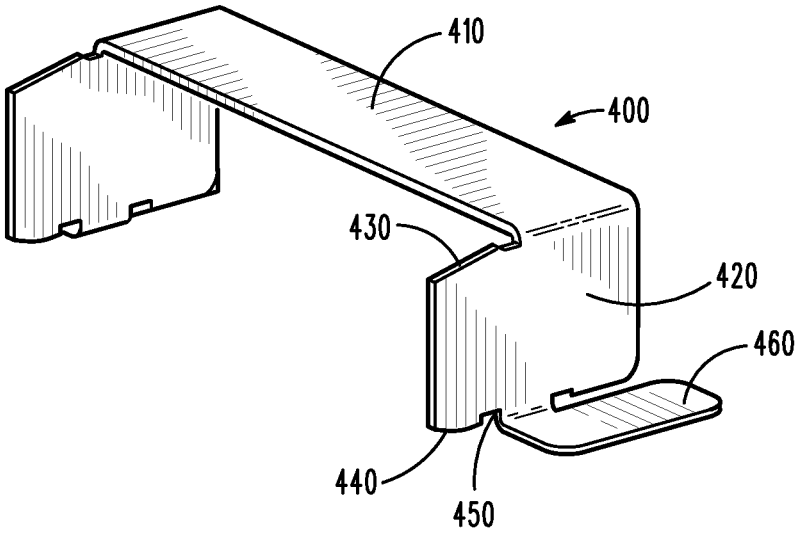
FIG. 6 is a perspective view of a support bracket in accordance with an exemplary embodiment of the invention.

After support brackets 400 are in position, a bottom plate 300 slides into position such that it mates with protrusions 75. Bottom plate 300 slides below sides 420 of support brackets 400 and holds support brackets 400 in place by, in this example, pushing tabs 460 firmly into slots 80. Each side 420 has, in this example, an angled lower edge 440 that assists in the insertion of bottom plate 300. As shown in FIG. 6, this example includes a notch 450 behind angled lower edge 440. Notch 450 can capture a lip on the edge of bottom plate 300 to further lock bottom plate 300 in position. After bottom plate 300 is in position, it can be held be one or more screws or other fasteners. In this example, bottom plate 300 is held by two screws inserted horizontally into base plate 70.

Figure 4:
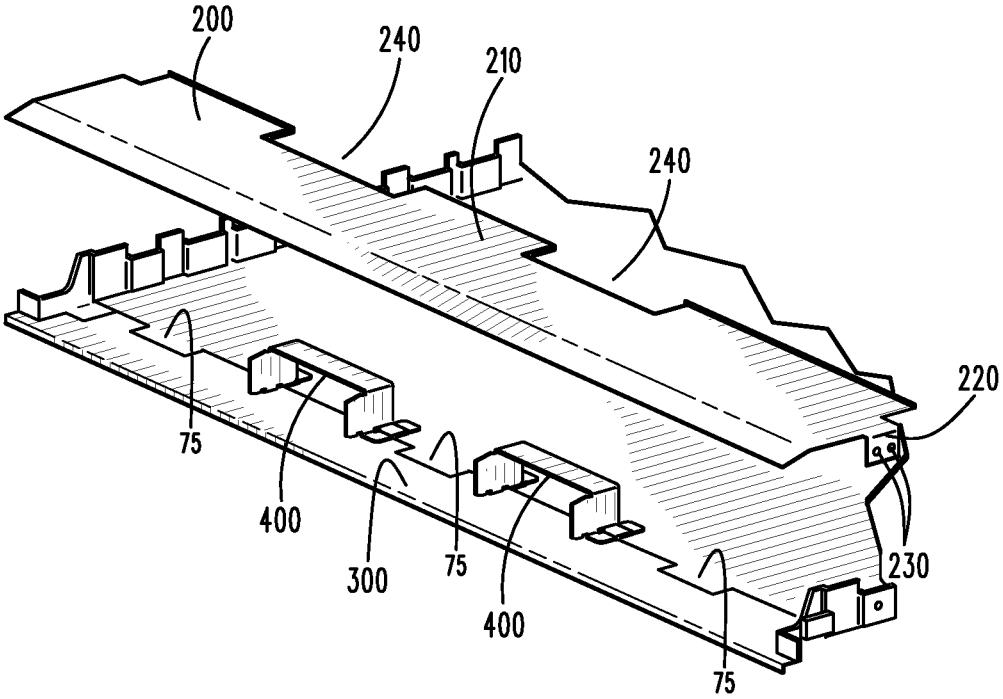
FIG. 4 is a partial perspective view of a portion of a baffle in accordance with an exemplary embodiment of the invention, including the baffle top not in position.
Figure 5:
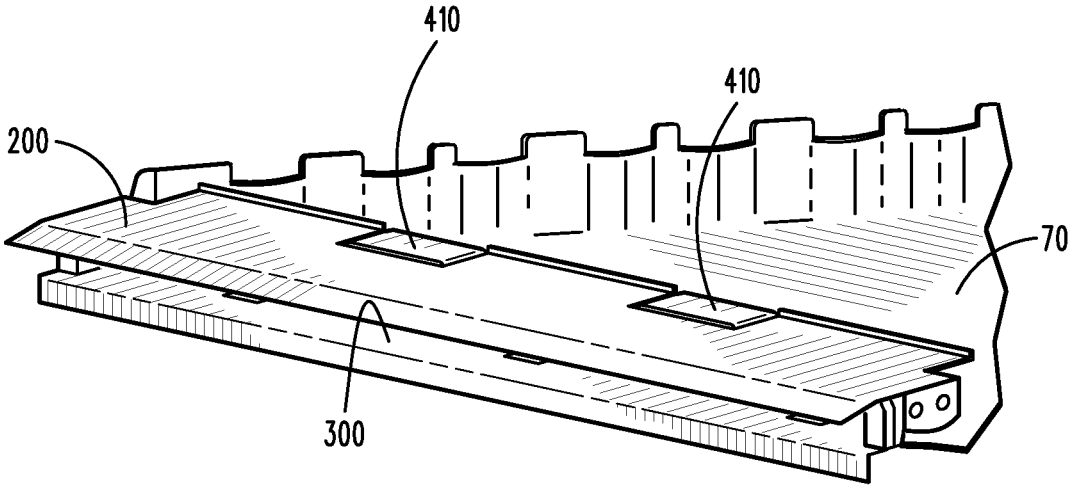
FIG. 5 is a partial perspective view of a portion of a baffle in accordance with an exemplary embodiment of the invention, including the baffle top in position.

After support brackets 400 and bottom plate 300 are in position, a top plate 200 is installed as shown in FIGS. 4 and 5. Top plate 200 has an upper plate 210 that is substantially flat in this example with a slight bend to form a slightly downwardly sloping profile. A tab 220 is provided on each end for attachment of top plate 200 to bottom plate 300 and base plate 70 by way of, in this example, two holes 230. FIG. 5 shows top plate 200 in position and ready to be held in position by screws (not shown) in holes 230. Upper plate 210 directs hot gases ejected from baffle 100 downwardly (in this example) and away from the oven to assist in cooling the oven.

Top plate 200 has a plurality of cut outs 240 that allow a bridging element 410 of each support bracket 400 to extend through top plate 200.

FIG. 6 shows an example of support bracket 400. In this example, support bracket 400 is formed from a piece of sheet metal such as, for example, stainless or galvanized steel. Bridging element 410 of support bracket 400 connects two substantially vertical (in this example) sides 420. Each side 420 has a tab 460 extending from it. As discussed above, tabs 460 slide into slots 80 of base plate 70 to correctly position support bracket 400. The interaction between tabs 460 and slots 80 also hold support bracket 400 in position vertically.

As shown in FIG. 6, each side 420 of support bracket 400 has a bearing surface 430 that is, in this example, sloped toward the front of support bracket 400. Bearing surfaces 430 provide support for top plate 200 so that top plate 200 does not sag along the horizontal direction. This is advantageous because (in this example) top plate 200 does not bear on bridging element 410 and the only support other than at the ends of top plate 200 is provided by bearing surfaces 430. Bridging element 410 supports a portion of the weight of oven 50 and transmits this weight down onto base plate 70. By providing cut outs 240 in top plate 200, top plate 200 is not subjected to the weight of oven 50. This can avoid bending or other unsightly distortion of top plate 200.

Figure 7:
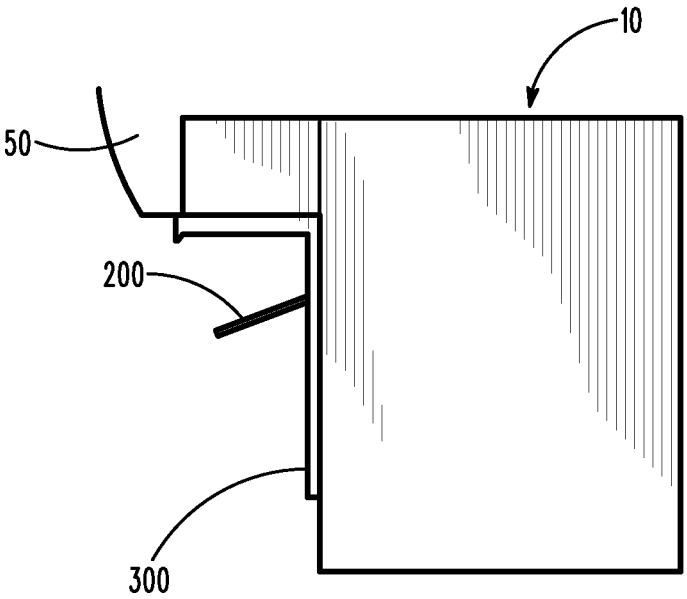
FIG. 7 is a side view of a baffle in accordance with an exemplary embodiment of the invention in position with a domestic appliance in a cabinet.

FIG. 7 is a side view of an example of an embodiment of the invention that shows top plate 200 protruding from cabinet 10 below oven 50. FIG. 7 also shows a lip of bottom plate 300 (shown in FIGS. 2-5) being flush with other trim associated with oven 50.

Although the above example is directed to an exhaust baffle for a domestic built in oven, the invention can also be applied to other domestic appliances that need to exhaust gases.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. An exhaust baffle for exhausting hot gas from around a domestic appliance having a base, the exhaust baffle comprising:

a support bracket having two tabs, the tabs being configured to slide into engagement with slots formed in the base of the domestic appliance, two support elements, each of the support elements extending from one of the tabs at a first angle that is greater than zero degrees and having a bearing surface, and a bridging element that extends from the two support elements at a second angle that is greater than zero degrees, the bridging element connecting the two support elements;

a baffle top having two opposite ends, a hot gas directing portion that rests on the bearing surfaces of the support bracket, an opening that receives the bridging element, and an attachment bracket at each of the two ends, the attachment brackets each having at least one attachment member that attaches the baffle top to at least one of the baffle bottom and the base of the domestic appliance; and a baffle bottom having a substantially flat member, the baffle bottom holding the support bracket in the slots when the baffle bottom is in an operating position.

2. The baffle of claim 1, wherein the first angle is substantially a right angle.

3. The baffle of claim 2, wherein the second angle is substantially a right angle.

4. The baffle of claim 3, wherein the baffle comprises two of the support brackets.

5. The baffle of claim 4, wherein the tabs, support elements and bridging elements of the support brackets are sheet material and the bearing surfaces are edges of the support elements.

6. The baffle of claim 4, wherein the support brackets are held in the slots by only the baffle bottom.

7. The baffle of claim 6, wherein the baffle is configured to support a weight of the domestic appliance on the bridging elements such that the weight of the domestic appliance is transferred through the bridging elements, then through the support elements, and to the appliance base, such that the baffle top does not support any of the weight of the domestic appliance.

8. An exhaust baffle/appliance base combination for exhausting hot gas from around a domestic appliance, the combination comprising:

a base of the domestic appliance, the base having slots formed therein;

a support bracket having two tabs, the tabs sliding into engagement with the slots formed in the base of the domestic appliance, two support elements, each of the support elements extending from one of the tabs at a first angle that is greater than zero degrees and having a bearing surface, and a bridging element that extends from the two support elements at a second angle that is greater than zero degrees, the bridging element connecting the two support elements;

a baffle top having two opposite ends, a hot gas directing portion that rests on the bearing surfaces of the support bracket, an opening that receives the bridging element, and an attachment bracket at each of the two ends, the attachment brackets each having at least one attachment member that attaches the baffle top to at least one of the baffle bottom and the base of the domestic appliance; and a baffle bottom having a substantially flat member, the baffle bottom holding the support bracket in the slots when the baffle bottom is in an operating position.

9. The combination of claim 8, wherein the first angle is substantially a right angle.

10. The combination of claim 9, wherein the second angle is substantially a right angle.

11. The combination of claim 10, wherein the baffle comprises two of the support brackets.

12. The combination of claim 11, wherein the tabs, support elements and bridging elements of the support brackets are sheet material and the bearing surfaces are edges of the support elements.

13. The combination of claim 11, wherein the support brackets are held in the slots by only the baffle bottom.

14. The combination of claim 13, wherein the combination supports a weight of the domestic appliance on the bridging elements such that the weight of the domestic appliance is transferred through the bridging elements, then through the support elements, and to the appliance base, such that the baffle top does not support any of the weight of the domestic appliance.

15. A domestic appliance that exhausts hot gas, the domestic appliance comprising:

an appliance body including a heat source;

a base having slots formed therein;

a support bracket having two tabs, the tabs sliding into engagement with the slots formed in the base, two support elements, each of the support elements extending from one of the tabs at a first angle that is greater than zero degrees and having a bearing surface, and a bridging element that extends from the two support elements at a second angle that is greater than zero degrees, the bridging element connecting the two support elements;

a baffle top having two opposite ends, a hot gas directing portion that rests on the bearing surfaces of the support bracket, an opening that receives the bridging element, and an attachment bracket at each of the two ends, the attachment brackets each having at least one attachment member that attaches the baffle top to at least one of the baffle bottom and the base of the domestic appliance; and a baffle bottom having a substantially flat member, the baffle bottom holding the support bracket in the slots when the baffle bottom is in an operating position.

16. The domestic appliance of claim 15, wherein the first angle is substantially a right angle and the second angle is substantially a right angle.

17. The domestic appliance of claim 16, wherein the baffle comprises two of the support brackets.

18. The domestic appliance of claim 17, wherein the tabs, support elements and bridging elements of the support brackets are sheet material and the bearing surfaces are edges of the support elements.

19. The domestic appliance of claim 17, wherein the support brackets are held in the slots by only the baffle bottom.

20. The domestic appliance of claim 19, wherein the baffle supports a weight of the domestic appliance on the bridging elements such that the weight of the domestic appliance is transferred through the bridging elements, then through the support elements, and to the appliance base, such that the baffle top does not support any of the weight of the domestic appliance.

* * * * *